US011332979B2

(12) United States Patent
Deolalikar et al.

(10) Patent No.: US 11,332,979 B2
(45) Date of Patent: May 17, 2022

(54) DRIVEN ROTARY STEERING SYSTEM HAVING VARIABLE-APERTURE VALVE ORIFICES

(71) Applicant: Halliburton Energy Services, Inc., Houston, TX (US)

(72) Inventors: Neelesh V. Deolalikar, Houston, TX (US); Ravi Nanayakkara, Kingwood, TX (US); Rui Huang, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/770,900

(22) PCT Filed: Mar. 27, 2018

(86) PCT No.: PCT/US2018/024619
§ 371 (c)(1),
(2) Date: Jun. 8, 2020

(87) PCT Pub. No.: WO2019/190482
PCT Pub. Date: Oct. 3, 2019

(65) Prior Publication Data
US 2021/0172254 A1 Jun. 10, 2021

(51) Int. Cl.
*E21B 7/06* (2006.01)
*E21B 17/10* (2006.01)
*E21B 21/10* (2006.01)

(52) U.S. Cl.
CPC ..... *E21B 7/06* (2013.01); *E21B 7/062* (2013.01); *E21B 17/1014* (2013.01); *E21B 21/10* (2013.01)

(58) Field of Classification Search
CPC ..... E21B 7/06; E21B 7/062; E21B 17/1014; E21B 21/10; E21B 3/00
See application file for complete search history.

(56) References Cited

U.S. PATENT DOCUMENTS 4,726,759 A 2/1988 Wegener
2009/0086576 A1 4/2009 Downton et al.
(Continued)

FOREIGN PATENT DOCUMENTS

WO 2016164192 A1 10/2016
WO 2017120505 A1 7/2017

OTHER PUBLICATIONS

European Extended Search Report dated Jul. 8, 2021; European Patent Application No. 18911729.4.
(Continued)

*Primary Examiner* — Yong-Suk (Philip) Ro
(74) *Attorney, Agent, or Firm* — McGuireWoods LLP

(57) ABSTRACT

The disclosed embodiments relate to a rotary steering having a plurality of hydraulically actuated steering pad assemblies and a valve positioned between a primary flow channel of the rotary steering tool and an actuating piston of each of the plurality of steering pad assemblies. The representative valve includes a two-disk valve, with an uphole disk having a single, fixed-area aperture and a downhole disk having a plurality of independently variable-area orifices. Each of the independently variable valve orifices corresponds to one of a plurality of valve ports. In turn, each valve port being is fluidly coupled to, and operable to actuate, a corresponding piston of one of the plurality of steering pad assemblies. The independently variable-area orifices can be manipulated (gradually opened or closed) to vary the pressure drop across the tool, and thereby vary the magnitude of hydraulic force available to actuate the steering pad assemblies.

20 Claims, 8 Drawing Sheets

(56) References Cited

U.S. PATENT DOCUMENTS

| | | | | |
|---|---|---|---|---|
| 2012/0160563 | A1 | 6/2012 | Clark et al. | |
| 2012/0160565 | A1 | 6/2012 | Downton et al. | |
| 2015/0337601 | A1 | 11/2015 | Niina et al. | |
| 2016/0326863 | A1* | 11/2016 | Lange | E21B 47/02 |

OTHER PUBLICATIONS

International Search Report and Written Opinion dated Dec. 26, 2018. International PCT Application No. PCT/US2018/024619.

* cited by examiner

DRIVEN ROTARY STEERING SYSTEM HAVING VARIABLE-APERTURE VALVE ORIFICES

TECHNICAL FIELD

The present disclosure relates to systems and methods for rotary directional drilling.

BACKGROUND

To facilitate the drilling of non-linear wellbores, rotary steering systems may be deployed to steer the path of a drill bit along a desired are wellbore path. Such systems are configured to rotate while the drill string that includes the bit is being rotated. The rotary steering system (RSS) may be controlled by an operator, such as an engineer, who controls the system via a surface controller by using mud pulse telemetry or a similar method of communication. Commands generated by the surface controller may be received at an on board controller that is local to a steering subassembly to cause deflection of the drill bit in a desired direction (during rotation of the drill string) to complete the drilling operation.

BRIEF DESCRIPTION OF THE DRAWINGS

Illustrative embodiments of the present disclosure are described in detail below with reference to the attached drawing figures, which are incorporated by reference herein, and wherein.

Figure 1:
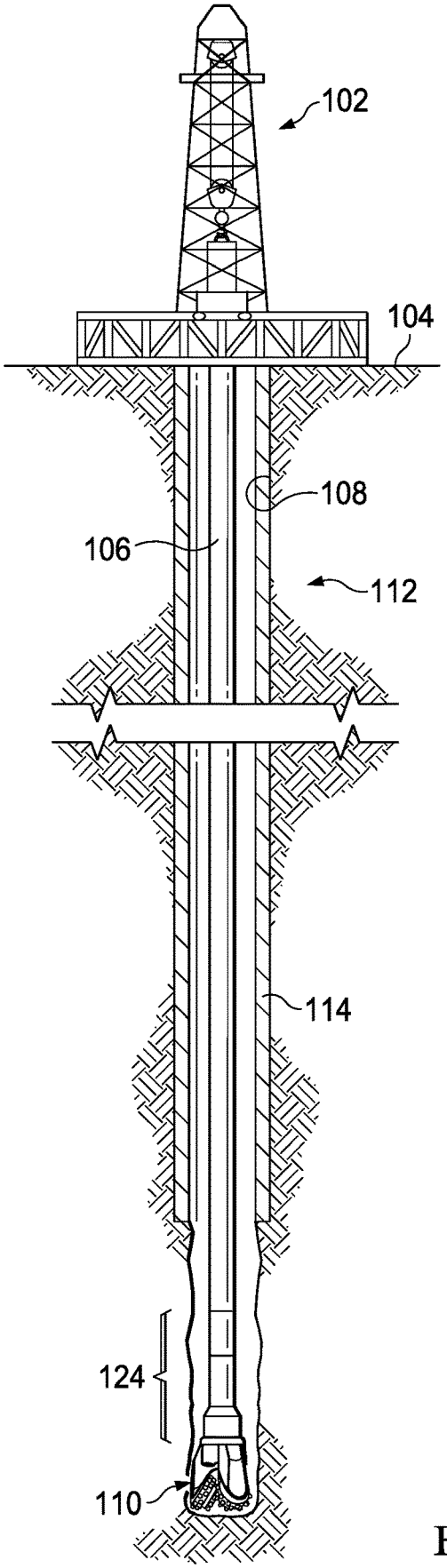
FIG. 1 is a schematic, side view of a wellsite having a borehole that extends into a subterranean formation.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical algorithmic changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to a rotary steering tool and related systems and methods, wherein the rotary steering tool has a plurality of hydraulically actuated steering pad assemblies and a valve positioned between a primary flow channel of the rotary steering tool and an actuating piston of each of the plurality of steering pad assemblies. The representative valve includes a two-disk valve, with an uphole disk having a single, fixed-area aperture and a downhole disk having a plurality of independently variable-area orifices. Each of the independently variable valve orifices corresponds to one of a plurality of valve ports. In turn, each valve port being is fluidly coupled to, and operable to actuate, a corresponding piston of one of the plurality of steering pad assemblies. The independently variable-area orifices can be manipulated (gradually opened or closed) to vary the pressure drop across the tool, and thereby vary the magnitude of hydraulic force available to actuate the steering pad assemblies.

To accomplish deflection during drilling, the rotary steering system may include steering pads or similar biasing mechanisms that exert a force against a portion of the wellbore wall and a portion of the rotary steering system as the drill bit continues to rotate. The deflection induced by the biasing mechanisms alters the trajectory of the drill bit in accordance with the commands received from the surface controller. The biasing mechanism may be one of several types, including a "push-the-bit" biasing mechanism that deflects the bit by exerting a force between the wellbore wall and a drive-shaft coupled to the bit. A push-the-bit biasing mechanism may comprise, for example, a plurality of thrust pads that are controllably, radially extendable from the tool string to engage and exert a force against the wellbore wall that results in an opposing force being applied to the tool string. To facilitate operation of such thrust pads, certain components within the steering system are held stationary relative to the formation (i.e., "geostationary"). These components may be coupled to a geostationary portion of the tool string, and may include a counter-driven shaft and an upstream disk of a geostationary valve. As referenced herein, the term geostationary generally indicates that the referenced object is rotationally stationary relative to the earth even if it is in motion relative to an object to which it is affixed (e.g. by a bearing interface). To that end, the geostationary valve and driveshaft of the tool string may rotate counter the direction of rotation of the drill string at an angular velocity that is equal and opposite to the angular velocity of the portion of the drill string to which it is affixed. By making valve geostationary, the thrust pads may be operated to generate a vector force that is substantially constant relative to the formation (by extending on or more pads toward the formation in the same periodic interval as the pads rotate within the tool string) in order to produce controlled deflection of the drill bit.

To maintain a geostationary valve and driveshaft of the drill string with a net zero rotation relative to the formation, motion counter to the rotation of the drill string is generated resulting in a net zero rotation relative to the formation. In some embodiments, drilling fluid flow may be used to power a turbine or motor that counter rotates the geostationary valve and driveshaft of the rotary steering system. The drilling fluid flow is directed across a turbine or mud motor that turns in the target direction. Various devices, such as a continuously variable transmission, or electromagnetic clutches engaged to the counter rotating turbine may be used to adjust speed of the counter rotating member.

The rotary steering system of this disclosure provides a mechanism for driving the counter-rotation of the geostationary valve and driveshaft of a rotary steering tool using a self-contained drive system. The system includes a downhole generator and turbine to provide efficient counter-rotation of the geostationary valve and driveshaft of the tool without the need for an external electrical power supply. In some implementations, tool operation and performance is affected by the pressure drop t. This pressure drop may affect the available pressure drop that is available for actuation of the steering pads that are used to control the direction of drilling. The referenced pressure drop may be taken as the difference between the pressure within the primary flow channel of the tool string and the pressure in the annulus (outside of the tool string) formed by the boundaries of the tool string and the wellbore at the bit. In accordance with the present disclosure, it may be desirable in some instances to increase the pressure drop.

Increasing the pressure drop may be accomplished in some instances by changing the fluid properties of the return fluid in the annulus to effect a drop in the annulus pressure. Changing the fluid properties of the fluid in the annulus, however, may be difficult to accomplish and subject to external limitations, such as limitations supplied by the formation type and drilling capabilities at the surface.

The present disclosure provides for placement of a variable restriction in the tool bore and variable restrictions in the valve ports of the downhole disk of the geostationary valve as complementary or alternative mechanisms for manipulating the pressure drop across the tool. The variable restrictions enable an operator to increase the pressure drop by raising the pressure in the tool bore without having to effect a change in the annulus pressure. As suggested previously, this may be useful in the case of a rotary steering system having steering pads or steering pad assemblies that are actuated by hydraulic pistons, wherein the force provided to the steering pads is a function of the referenced pressure drop. In such a system, a larger pressure drop may be desired to ensure actuation actuate the pistons, and the variable restrictions can be adjusted to optimize the push force of the pistons. The variable restrictions may take the form of a variable-aperture orifice that can be created using a number of valve designs, including a poppet valve, a gate valve, or any other suitable valve.

In an exemplary rotary steering system tool, the pressure acting on each steering pad may be considered as a function of the pressure drop across the bit. This pressure drop is in turn a function of the flow across the bit. Use of a variable-aperture orifice allows for dynamic adjustment of flow through a parallel flow channel that provides for actuation and operation of the hydraulic pistons that control the steering pads by adjustment of the flow across the bit. To that end, adjustment of the variable-aperture orifice provides a corresponding adjustment in the pressure acting on the steering pads, which in turn affects the steering force each pad exerts on the wall of the wellbore. This disclosure provides for multiple methods for controlling flow to the steering pistons and flow across the bit. Related systems and methods may involve using a valve disk in which variable-aperture orifices are operable to direct flow to each steering piston to cause expansion or contraction of the piston as needed during drilling.

An exemplary geostationary valve includes a fixed lower disk with three ports, one corresponding to each steering pad, and a rotating upper disk that has a single aperture and is counter-rotated to remain static relative to the formation. The counter-rotation may be powered by a turbine and motor/generator system, with the speed and direction of rotation or the valve determined by a downhole controller. The variable-aperture orifices may be positioned on the lower disk of the valve. Alternatively or in addition, a variable-aperture orifices may be incorporated into the upper disk of the valve. In other embodiments, a variable flow area may be created by designing a disk with channels to larger flow areas that could be opened or shut as desired.

Turning now to the figures, FIG. 1 shows a drilling rig 102 located at or above a surface 104. The rig 102 includes a rotating drill string 106 that is shown extending into a wellbore 108. A drive system at the surface 104 causes rotation of the drill string 106, which includes a drill bit 110 that forms the wellbore 108 as the drill bit 110 penetrates a geological formation 112. The wellbore 108 may be uncased, or may include a casing 114 to reinforce the wall of the wellbore 108 and prevent the undesired ingress of fluid from the cased portions of the wellbore. The drill string 106 includes a rotary steering system 124 that is operable to induce lateral displacement of the drill bit 110 to alter the path the drill bit 110 follows as it forms the wellbore 108.

Figure 2:
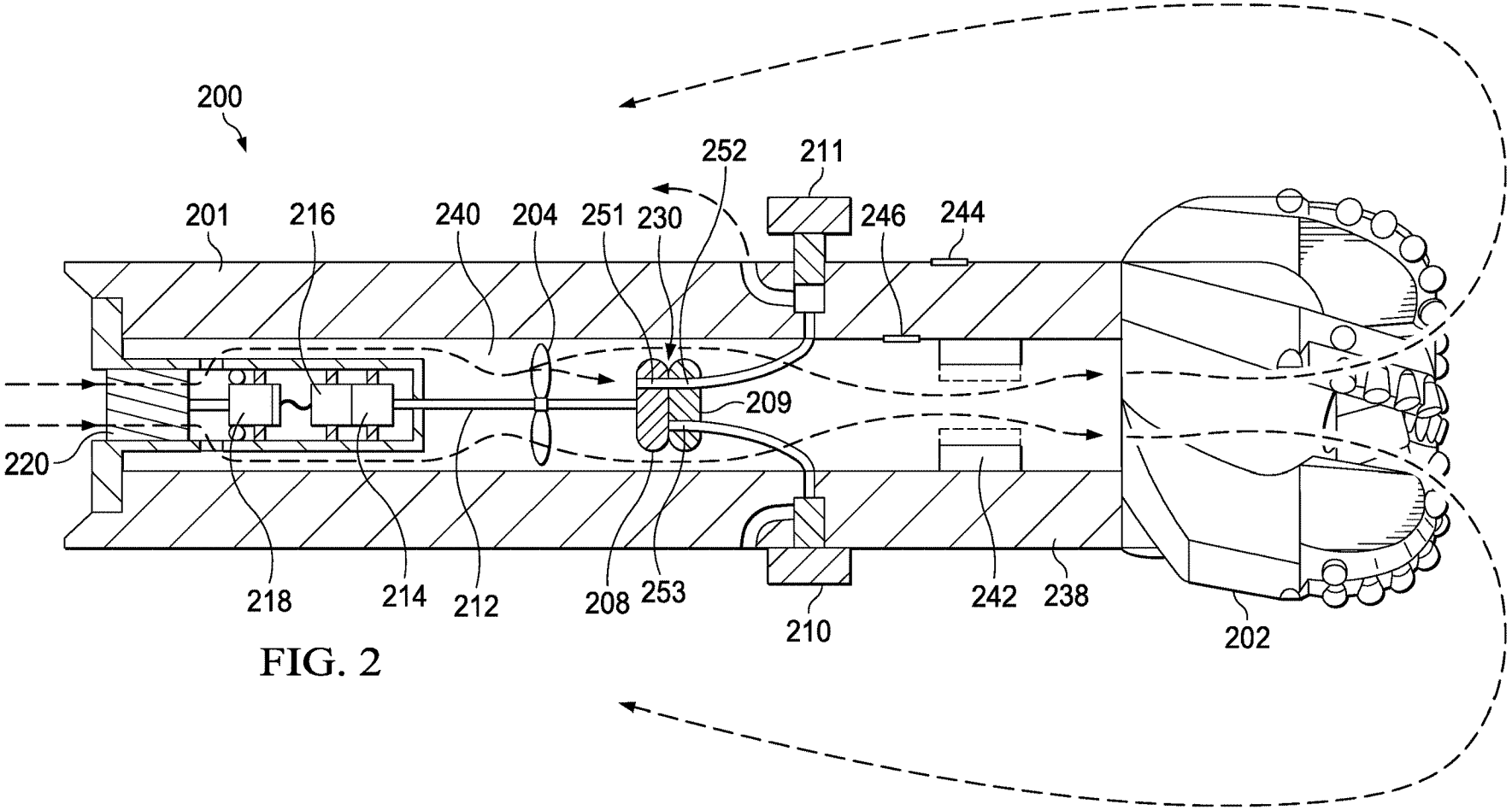
FIG. 2 is a schematic, side view, in partial cross-section, showing a rotary steering system subassembly.

FIG. 2 shows an example of a rotary steering system 200 in accordance with an embodiment of the present disclosure, and analogous to the rotary steering system 124 of FIG. 1. The rotary steering system 200 includes a tool housing 201 that includes a number of components, including a geostationary valve 230. The geostationary valve 230 may be a disk valve having a geostationary upper disk 208 and a lower disk 209 that rotates with the rotary steering system 200. The lower disk 209 of the geostationary valve 230 is rotationally coupled to a rotating bottom-hole assembly 238 that rotates a drill bit 202. Similarly, the upper disk 208 of the geostationary valve 230 is coupled to the driveshaft at an uphole interface of the rotary steering system 200. As referenced herein, "upper" generally refers to "uphole", or as taken along the path of the wellbore, closer to the surface. Correspondingly, "lower" generally refers to "downhole", or as taken along the path of the wellbore, further from the surface.

The lower disk 209 of the geostationary valve 230 includes valve ports, or apertures that are each fluidly coupled to a piston of a one of a plurality of thrust pad assemblies. The thrust pad assemblies include steering pads 210, 211, and are spaced circumferentially about the rotary steering system 200 to engage the wall of the wellbore and exert a lateral force on the rotary steering system 200 and, in turn, the drill bit 202. The steering pads 210, 211 may be actuated by the geostationary valve 230. In the illustration of FIG. 2, only two steering pads 210, 211 are shown for illustrative purposes. In many embodiments, however, the rotary steering system 200 includes three steering pads or more. During drilling, the upper disk 208 of the geostationary valve 230 is maintained in a substantially static orientation relative to the formation, while the lower disk 209 is permitted to rotate. As the lower disk rotates, a geostationary aperture 251 of the upper disk 208 is periodically aligned with rotating apertures 252, 253, thereby delivering fluid to the pistons of the thrust pad assemblies in succession. The steering pads 210, 211 are thereby actuated as steering tool 200 rotates, each time in the same rotational position to bias the steering tool in a desired direction.

To remain stationary relative to the formation, the upper disk 208 of the geostationary valve 230 is rotationally driven, relative to the rotating steering tool and bottom-hole assembly 238 in the opposite rotational direction but at the same magnitude as the rate of rotation as the rotating tool and bottom-hole assembly 238. To facilitate such counter-rotation, the upper disk 208 of the geostationary valve 230 is coupled to a drive system via a drive shaft 212. The drive shaft 212 is coupled to a turbine 204 that is operable to rotate in response to drilling fluid being circulated through a central flow channel 240, or primary bore, of the rotary steering system 200. In some embodiments, the turbine 204 is coupled to the drive shaft 212 using an optional clutch interface that selectively engages the drive shaft 212 or that allows the turbine 204 to drive the drive shaft 212 in solely in a desired direction of rotation.

In some embodiments, the drive shaft 212 is also coupled to a generator 214, which is in turn coupled to a controller 216 and an energy store 218. The energy store 218 may alternatively be referred to as a power source, and is communicatively coupled to the controller 216, which is also communicatively coupled to the generator 214. The generator may include a rotor and stator configuration, and may also be operated by the controller 216 to operate as a motor to drive the drive shaft 212. The drive shaft 212 may also be coupled to a resistor 220 or similar structure that is operable to dissipate energy by heat transfer or otherwise. To facilitate control of the pressure drop across the drill bit 202, which may function as a fluid outlet of the tool bore, the rotary steering system 200 may include a variable-orifice valve 242 downhole from the geostationary valve 230 that actuates the steering pads 210, 211 and uphole from the drill bit 202. Similarly, to facilitate control of the pressure differential across the steering pads 210, 211, the geostationary valve 230 may be configured with a plurality of independently variable-aperture orifices, as described in more detail below. The variable-orifice valve 242 and geostationary valve 230 may be coupled to and actuated by the controller 216, which may also be coupled to a first pressure sensor 244 operable to determine a pressure measurement within the bore of the tool uphole from the drill bit 202 and a second pressure sensor 246 operable to determine a pressure measurement within the annulus between the wellbore and exterior of the tool string just uphole from the bit to determine a measurement of the pressure differential.

Figure 3:
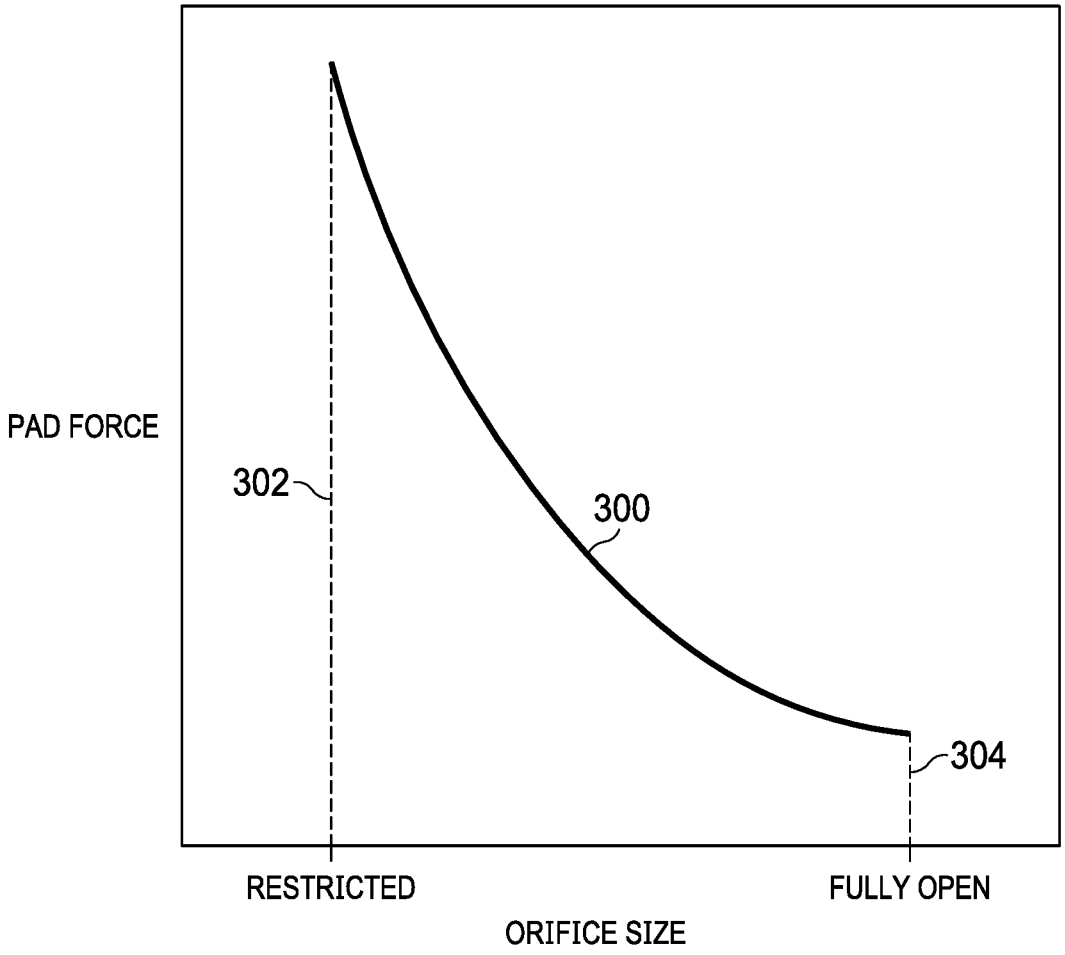
FIG. 3 is a chart showing the relationship between steering pad force magnitude and the magnitude of the pressure differential across a drill bit of a tool string that includes a rotary steering system.

In the accompanying figures, FIG. 3 shows a pressure curve demonstrating the relationship between the pressure differential between the pressure at the steering valve (e.g., geostationary valve 230 described above), and the annulus of the wellbore. An associated force curve 300 demonstrates that pad force reaches an upper limit 302 when the differential is maximized (and the valve is near fully restricted, and a lower limit 304 when the differential is minimized and the valve is fully open.

Figure 4A:
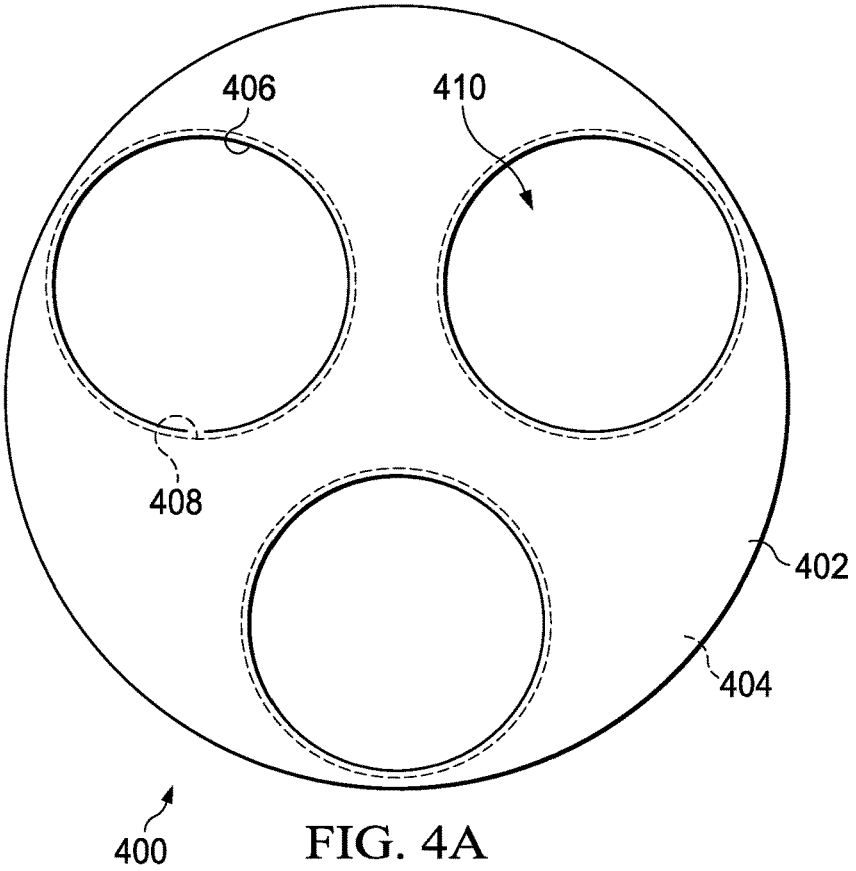
FIG. 4A is a schematic, top view of a portion of a lower disk of a geostationary valve that includes a variable orifice valve in a first, unrestricted configuration.
Figure 4B:
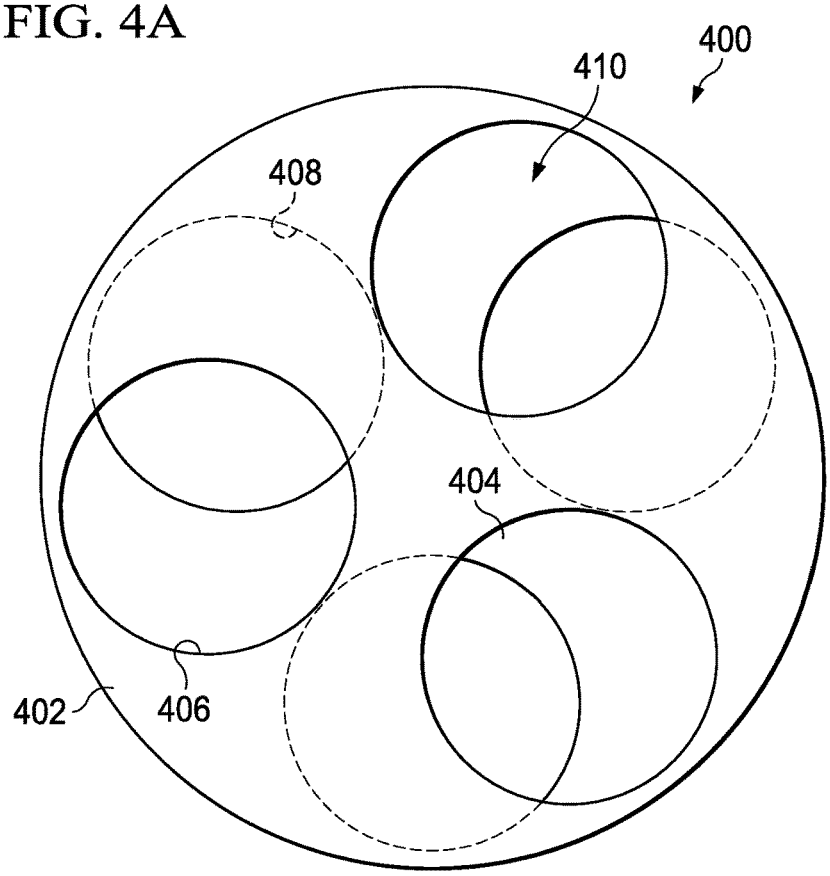
FIG. 4B is a schematic, top view of a portion of a lower disk of a geostationary valve that includes a variable orifice valve in a second, partially restricted configuration.

An embodiment of a lower disk 400 having independently variable-area orifices 410 is depicted in FIGS. 4A and 4B. The disk 400 includes an upper portion 402 and a lower portion 404 which are controllably rotatable with respect to one another using, for example, an electronic controller that is communicatively coupled to the controller of the rotary steering system. The upper portion 402 includes upper apertures 406 and the power portion includes lower apertures 408 that are each equidistant from the axis of the lower disk 400. The upper portion 402 and lower portion 404 are operable to rotate with respect to another, by rotation of one or both components. Such rotation may be controlled to vary the size of independently variable-area orifices 410. FIG. 4A shows the lower disk 400 in a fully open configuration in which the upper portion 402 is rotated relative to the lower portion 404 to a position in which the upper apertures 406 directly overly the lower apertures 408 to cause the independently variable-area orifices 410 to be fully open. Conversely, FIG. 4B shows the lower disk 400 in a partially restricted configuration in which the upper portion 402 is rotated relative to the lower portion 404 to a position in which the upper apertures 406 are partially misaligned with the lower apertures 408 to cause the independently variable-area orifices 410 to be partially restricted. In this manner, the independently variable-area orifices 410 may be controllably manipulated to a desired degree of openness ranging from fully open to fully closed.

Figure 5:
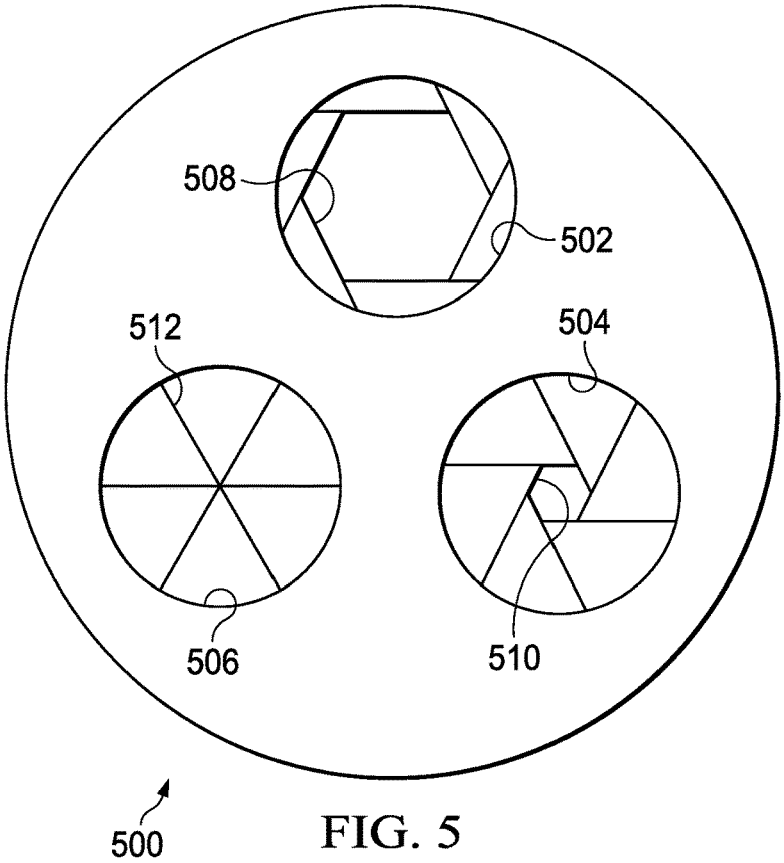
FIG. 5 is a schematic, top view of a portion of another embodiment of a lower disk of a geostationary valve that includes three variable orifice valves, wherein each valve provides a differing degree of restriction.

An alternative embodiment of a lower disk 500 is depicted in FIG. 5. Here, the lower disk 500 includes a first aperture 502, a second aperture 504, and a third aperture 506, each corresponding to a steering pad assembly of the steering system. To provide variable-aperture capability, a first shutter 508 is positioned in the first aperture 502, a second shutter 510 is positioned in the second aperture 504, and a third shutter 512 is positioned in the third aperture 506. Each shutter may be independently controlled by an associated controller to transition from a fully open state to a fully closed state, though in some embodiments, the variable-aperture orifice may all be operated in unison so that the relative degree of openness is the same for each orifice. In the embodiment of FIG. 5, the first aperture 502 is shown as being near fully open, the second aperture 504 is shown as partially restricted, and the third aperture 506 is shown as being fully restricted.

Figure 6A:
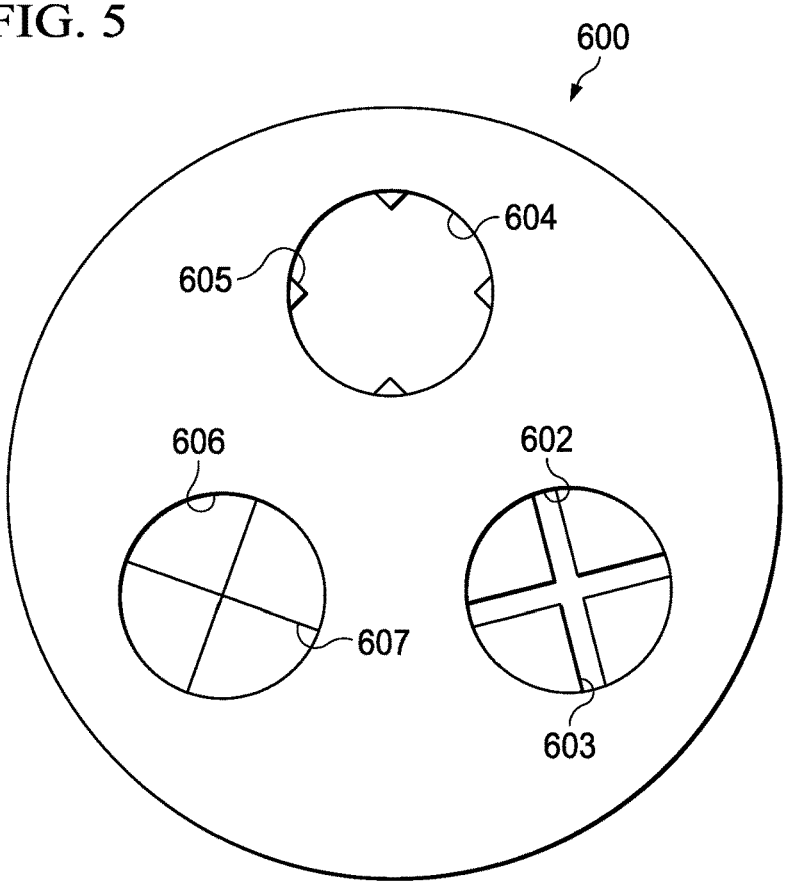
FIG. 6A is a schematic, top view of a portion of another embodiment of a lower disk of a geostationary valve that includes three variable orifice valves, wherein each valve provides a differing degree of restriction.
Figure 6B:
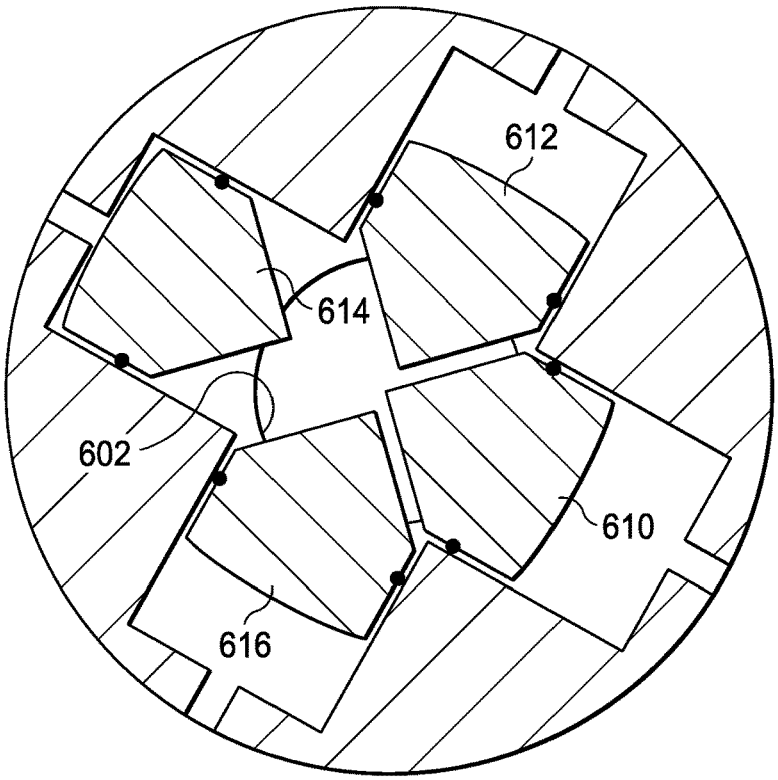
FIG. 6B is a detail, bottom view of one of the valve seats of FIG. 6A.

FIGS. 6A and 6B show a similar embodiment in which the relative size of the aperture is varied using a valve made up of adjacent pistons, which may be referred to as secondary pistons, and which may be individually actuated to partially close the valve. Here, an alternative embodiment of a lower disk 600 is depicted as including a first aperture 602, a second aperture 604, and a third aperture 606, each corresponding to a steering pad assembly of the steering system. To provide variable-aperture capability, a first group of secondary pistons 603 is positioned in the first aperture 602, a second group of secondary pistons 605 is positioned in the second aperture 604, and a third group of secondary pistons 607 is positioned in the third aperture 606. In the embodiment of FIG. 6A, the first aperture 602 is shown as being partially restricted, the second aperture 604 is shown as being fully open, and the third aperture 606 is shown as being fully restricted.

FIG. 6B shows an opposing, sectional view of the first aperture 602, which includes a first secondary piston 610, a second secondary piston 612, a third secondary piston 614, and a fourth secondary piston 616. Here, the first secondary piston 610, second secondary piston 612, and fourth secondary piston 616 are shown as being actuated to close off a portion of the first aperture 602, while the third secondary piston 614 is left in the unactuated state to leave the first aperture 602 partially restricted.

Figure 7:
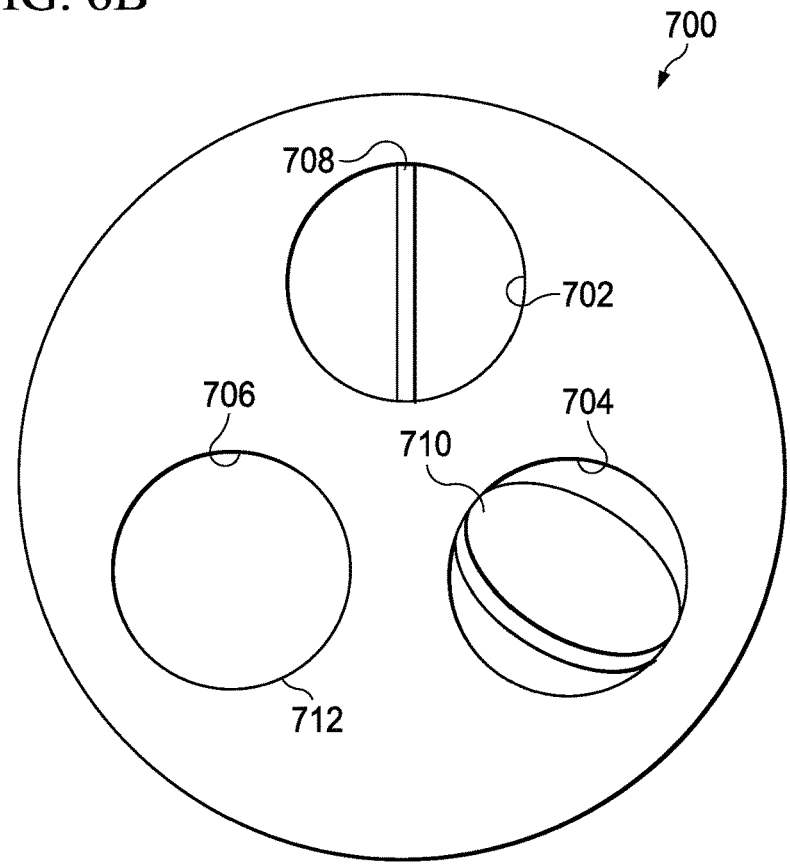
FIG. 7 is a schematic, top view of a portion of another embodiment of a lower disk of a geostationary valve that includes three variable orifice valves, wherein each valve provides a differing degree of restriction.

Another alternative embodiment of a lower disk 700 is depicted in FIG. 7. Here, the lower disk 700 includes a first aperture 702, a second aperture 704, and a third aperture 706, each corresponding to a steering pad assembly of the steering system. To provide variable-aperture capability, a first valve flap 708 is positioned in the first aperture 702, a second valve flap 710 is positioned in the second aperture 704, and a third valve flap 712 is positioned in the third aperture 706. Each valve flap may be independently controlled by an associated controller to transition from a fully open state to a fully closed state, though in some embodiments, the variable-aperture orifice may all be operated in unison so that the relative degree of openness is the same for each orifice. In the embodiment of FIG. 7, the first aperture 702 is shown as being near fully open, the second aperture 704 is shown as partially restricted, and the third aperture 706 is shown as being fully restricted.

In some embodiments, a variable-orifice valve (e.g., variable-orifice valve 242 of FIG. 2) may be positioned downhole of the steering pad assemblies (and downhole from the geostationary valve 230) so that the pressure drop may be controlled using a single valve. It is noted, however, that the variable-orifice valves described herein are not mutually exclusive and that each of the geostationary valve 230 and variable-orifice valve 242 may include variable-aperture orifices. To that end, the variable-orifice valve 242 may incorporate any of the concepts described above with respect to FIGS. 4A, 4B, 5, 6A, 6B, and 7 in addition to those described below. In particular, it is noted that the valve configuration described with regard to FIGS. 4A and 4B may be deployed as a downhole variable-orifice valve 242 rather than in connection with the geostationary valve 230.

Figure 8A:
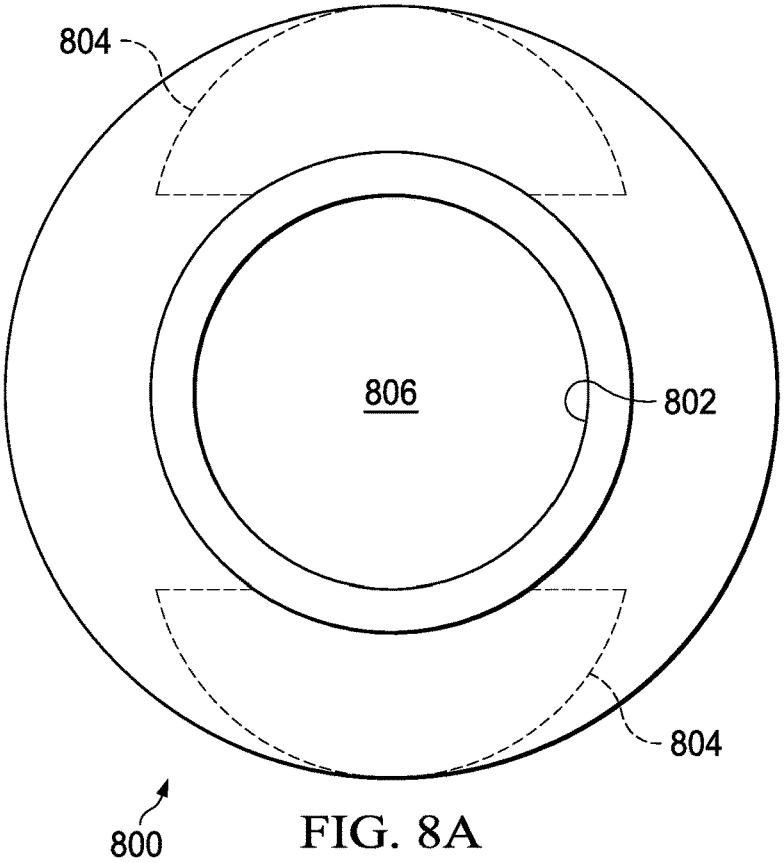
FIGS. 8A and 8B are schematic, top views of a valve that is positioned downhole of a steering pad subassembly to provide an enhanced pressure differential across the drill bit.
Figure 8B:
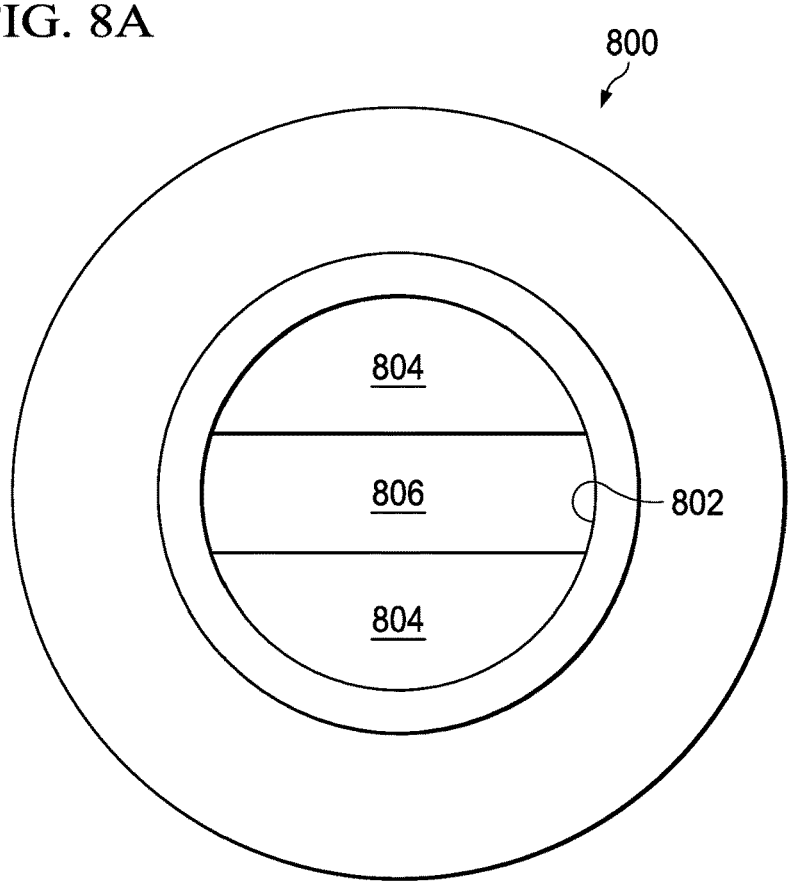

FIGS. 8A and 8B show additional examples. The embodiment of FIGS. 8A and 8B illustrate a variable-orifice valve 800 that includes a valve that may be operated by the controller of the steering system. A variable-aperture orifice 802 of the variable-orifice valve 800 may be operated in fully open configuration, as shown in FIG. 8A, or actuated to partially restrict the variable-aperture orifice 802 by closing the valve members 804 as shown in FIG. 8B.

Figure 9A:
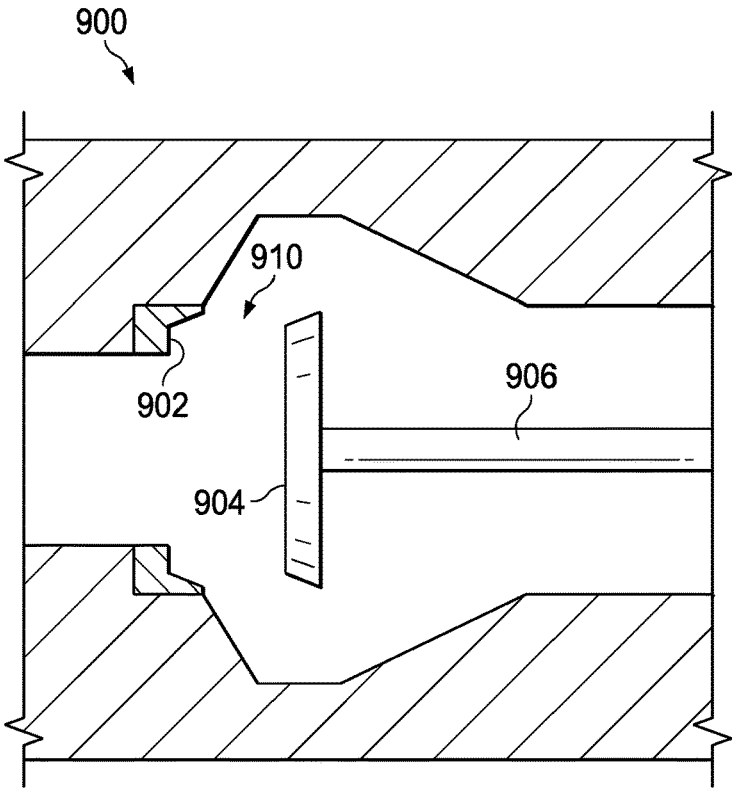
FIGS. 9A and 9B are schematic, top views of another embodiment of a valve that is suitable for positioning downhole of a steering pad subassembly to provide an enhanced pressure differential across the drill bit.
Figure 9B:
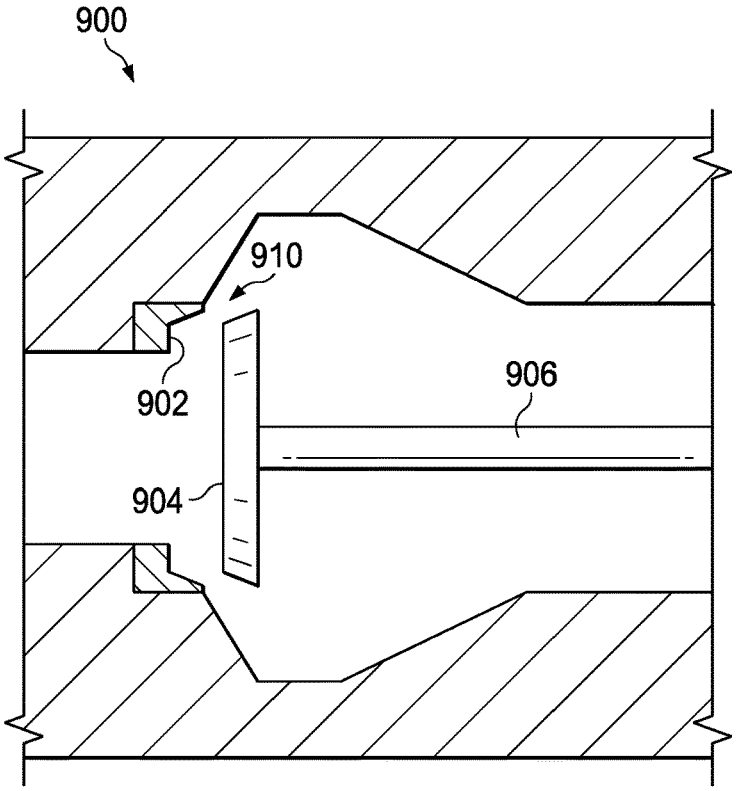

An alternative embodiment is shown in FIGS. 9A and 9B, which depict a cross-section view of a variable-orifice valve 900. The variable-orifice valve 900 includes a valve seat 902 and a sealing head 904 coupled to a piston 906 that may be actuated by a controller. The aperture 910 is shown in a side view and can be seen to be open in FIG. 9A, in which the sealing head 904 is withdrawn from the valve seat 902, and in a partially restricted configuration in FIG. 9B. In the partially restricted configuration, the sealing head 904 is moved toward the valve seat 902 to decrease the size of the aperture 910.

The present disclosure improves upon methods of setting the pressure drop across the bit using bit nozzles and an additional nozzle or orifice just above the bit. Using such a configuration, it becomes difficult to dynamically adjust the pressure drop across the bit as drilling conditions change downhole. The adjustable tool orifice described herein, however, provides for dynamic adjustment of the pressure drop downhole (with no change in equipment) to account for any changes in the drilling operating conditions as they occur.

Using typical drilling configurations, rig pumps are limited by the amount of pressure they can sustain. When a rotary steerable tool having fully rotating, mud-operated thrust pads is configured at a rig site, a set of drill bit nozzles and tool nozzle would be selected to generate a given pressure drop across the bit based on initially predicted parameters relating to expected flow, mud properties and planned well curvature. The embodiments described herein, however, may better be able to account for changes in operating conditions. For example, pumps may sustain a higher pressure when forming lateral sections of a wellbore than when forming vertical and curved sections due to the losses along a long length of the bore. In such a circumstance, flow may be reduced, which in turn may reduce the pressure drop across the bit. Any unwanted changes in the magnitude of the pressure drop could negatively impact hole cleaning and cuttings transport. In accordance with the present disclosure, unwanted changes in the magnitude of the pressure drop could be offset by changing the orifice size of a downhole valve (e.g., variable-orifice valve 242) (dynamically in real time) without affecting the flow rate of drilling mud through the bit.

In operation, and referring again to FIG. 2, any of the variable aperture valve orifices described above may be controllably actuated to vary the pressure drop across the bit. For example, it may be desirable in some cases to provide a greater magnitude of force to actuate the steering pads to achieve a desired amount of deflection of the steering assembly. In such an instance, a valve aperture of any one of the types described above may be actuated to partially restrict flow to increase the pressure drop and thereby increase the magnitude of the steering force.

To that end, a representative method of operating a rotary steering system 200 may include modifying a flow rate of fluid through a valve, which may be a geostationary valve 230. The rotary steering tool may include a plurality of hydraulically actuated steering pad assemblies 210, 211, the geostationary valve 230 fluidly coupled to the primary flow channel 240 of the rotary steering system 200 to selectively permit flow to the each of the plurality of steering pad assemblies 210, 211. The geostationary valve 230 includes a valve disk 209 having a plurality of valve ports, each valve port being associated with a corresponding piston of one of the plurality of steering pad assemblies, and each valve port comprising an independently variable-area orifice 410 (see FIGS. 4A and 4B). The method includes modifying the magnitude of a radial force being applied by at least one of the plurality of steering pad assemblies 210, 211 by modifying an open area of an independently variable-area orifice 410 associated with the at least one of the plurality of steering pad assemblies 210, 211.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, disclosed processes may be performed in parallel or out of sequence, or combined into a compound process. The scope of the claims is intended to broadly cover the disclosed embodiments and any such modification. Further, the following clauses represent additional embodiments of the disclosure and should be considered within the scope of the disclosure:

In a first exemplary embodiment, a rotary steering tool includes a tool housing defining a primary flow channel for passing drilling fluid to a drill bit coupled to a lower end of the tool housing. The rotary steering tool further includes a plurality of piston-operated steering pad assemblies coupled to the tool housing and a valve for controlling flow from the primary flow channel to the steering pad assemblies. The valve includes a first valve disk having a plurality of valve ports, with each valve port having an independently-variable orifice that is in fluid communication with a respective one of the piston-operated steering pad assemblies. The valve may further include a second, upper disk overlying the first disk, the second disk being rotatable relative to the first disk. The second, upper disk includes an aperture for periodically allowing flow from the primary flow channel to each of the plurality of valve ports. The independently variable-area orifice may include a shutter valve or a butterfly valve. In some embodiments, the independently variable-area orifice comprises a valve opening and a plurality of pistons, each piston being operable to extend toward the center of independently variable-area orifice to at least partially close the valve. The plurality of pistons may consist of four pistons having a triangular profile operable to engage the triangular profile of the adjacent pistons to at least partially close the valve.

In another exemplary embodiment, a method of operating a rotary steering tool includes modifying a flow rate of fluid through a valve. The rotary steering tool includes a tool housing defining a primary flow channel for passing drilling fluid to a drill bit coupled to a lower end of the tool housing. The rotary steering tool further includes a plurality of piston-operated steering pad assemblies coupled to the tool housing and a valve for controlling flow from the primary flow channel to the steering pad assemblies. The valve includes a first valve disk having a plurality of valve ports, with each valve port having an independently-variable orifice that is in fluid communication with a respective one of the piston-operated steering pad assemblies. The valve may further include a second, upper disk overlying the first disk, the second disk being rotatable relative to the first disk. The second, upper disk includes an aperture for periodically allowing flow from the primary flow channel to each of the plurality of valve ports. The method includes modifying the magnitude of a radial force being applied by at least one of the plurality of steering pad assemblies by modifying an open area of an independently variable-area orifice associated with the at least one of the plurality of steering pad assemblies. The independently variable-area orifice may include a shutter valve, and modifying the flow rate of fluid through the independently variable-area orifice may be performed by partially closing the shutter valve. Alternatively, the independently variable-area orifice may include a butterfly valve, and modifying the flow rate of fluid through the independently variable-area orifice may be performed by partially closing the butterfly valve. The independently variable-area orifice may include a valve opening and a plurality of pistons, each piston being operable to extend toward the center of the independently variable-area orifice to at least partially close the valve, and modifying the flow rate of fluid through the independently variable-area orifice may include extending one or more of the plurality of pistons. In some embodiments, the independently variable-area orifice comprises a shutter valve, and modifying the flow rate of fluid through the independently variable-area orifice may be performed by partially opening the shutter valve. In other embodiments, the independently variable-area orifice includes a butterfly valve, and modifying the flow rate of fluid through the independently variable-area orifice may be performed by partially opening the butterfly valve. In some embodiments, the independently variable-area orifice includes a valve opening and a plurality of secondary pistons, each secondary piston being operable to extend toward the center of the independently variable-area orifice to at least partially close the valve, and modifying the flow rate of fluid through the independently variable-area orifice may be performed by retracting one or more of the plurality of secondary pistons. The plurality of secondary pistons may include four secondary pistons, each secondary piston having a triangular profile operable to engage the triangular profile of the adjacent secondary pistons to at least partially close the valve.

In another exemplary embodiment, a system for drilling a non-linear wellbore includes a rotary steering tool includes a tool housing defining a primary flow channel for passing drilling fluid to a drill bit coupled to a lower end of the tool housing. The rotary steering tool further includes a plurality of piston-operated steering pad assemblies coupled to the tool housing and a valve for controlling flow from the primary flow channel to the steering pad assemblies. The valve includes a first valve disk having a plurality of valve ports, with each valve port having an independently-variable orifice that is in fluid communication with a respective one of the piston-operated steering pad assemblies. The valve may further include a second, upper disk overlying the first disk, the second disk being rotatable relative to the first disk. The second, upper disk includes an aperture for periodically allowing flow from the primary flow channel to each of the plurality of valve ports. The system may also include a bottom-hole assembly having a drill bit, a controller communicatively coupled to the valve, a first pressure sensor in fluid communication with a wellbore annulus, and a second pressure sensor in fluid communication with a bore of the bottom-hole assembly. The first pressure sensor and the second pressure sensor may be communicatively coupled to the controller. The controller may be operable to receive pressure measurements from the first pressure sensor and the second pressure sensor, and to determine a pressure drop across the drill bit based on the received pressure measurements, and wherein the controller is operable to modify a flow area of the independently variable-area orifice based on the determined pressure drop. The valve may include a valve disk having a plurality of valve ports, each valve port being associated a corresponding piston of one of the plurality of steering pad assemblies. The independently variable-area orifice may include a plurality of variable area orifices, wherein each of the plurality of valve ports has a variable-area orifice, and wherein the controller is operable to modify a flow area of each of the plurality of variable area orifices based on the determined pressure drop. The independently variable-area orifice may include a shutter valve or a butterfly valve. Alternatively, the independently variable-area orifice may include a valve opening and a plurality of pistons, each piston being operable to extend toward the center of the independently variable-area orifice to at least partially close the valve.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A rotary steering tool comprising:

a tool housing defining a primary flow channel for passing drilling fluid through a drill bit coupled to a lower end of the tool housing;

a plurality of piston-operated steering pad assemblies coupled to the tool housing; and a valve for controlling flow from the primary flow channel to the steering pad assemblies, the valve including a first valve disk having a plurality of valve ports, each valve port comprising an independently-variable area orifice in fluid communication with a respective one of the piston-operated steering pad assemblies, wherein the primary flow channel provides a fluid flow path for the drilling fluid to flow from the valve through the drill bit without flowing through the drilling pad assemblies.

2. The rotary steering tool of claim 1, wherein the valve further comprises:

a second, upper disk overlying the first disk, the second disk being rotatable relative to the first disk, wherein the second, upper disk comprises an aperture for periodically allowing flow from the primary flow channel to each of the plurality of valve ports.

3. The rotary steering tool of claim 1, wherein the independently-variable area orifice comprises a shutter valve.

4. The rotary steering tool of claim 1, wherein the independently-variable area orifice comprises a butterfly valve.

5. The rotary steering tool of claim 1, wherein the independently-variable-area orifice comprises a valve opening and a plurality of secondary pistons, each secondary piston being operable to extend toward the center of the independently-variable orifice to at least partially close the valve.

6. The rotary steering tool of claim 5, wherein the plurality of secondary pistons comprises four secondary pistons, each secondary piston having a triangular profile operable to engage the triangular profile of the adjacent secondary pistons to at least partially close the valve.

7. A method of operating a rotary steering tool, the method comprising:

modifying a flow rate of fluid through a valve, wherein the rotary steering tool comprises a tool housing defining a primary flow channel for passing drilling fluid through a drill bit coupled to a lower end of the tool housing, a plurality of piston-operated steering pad assemblies coupled to the tool housing, and a valve for controlling flow from the primary flow channel to the steering pad assemblies, the valve including a first valve disk having a plurality of valve ports, each valve port comprising an independently-variable-area orifice in fluid communication with a respective one of the piston-operated steering pad assemblies; and modifying the magnitude of a radial force being applied by at least one of the plurality of steering pad assemblies by modifying an open area of the independently variable-area orifice corresponding to one of the plurality of steering pad assemblies, wherein the primary flow channel provides a fluid flow path for the drilling fluid to flow from the valve through the drill bit without flowing through the drilling pad assemblies.

8. The method of claim 7, wherein the valve further comprises a second, upper disk overlying the first disk, the second disk being rotatable relative to the first disc, wherein the second, upper disc comprises an aperture for periodically allowing flow from the primary flow channel to each of the plurality of valve ports.

9. The method of claim 7, wherein the independently variable-area orifice comprises a shutter valve, and wherein modifying the flow rate of fluid through the independently variable-area orifice comprises partially closing the shutter valve.

10. The method of claim 7, wherein the independently variable-area orifice comprises a butterfly valve, and wherein modifying the flow rate of fluid through the independently variable-area orifice comprises partially closing the butterfly valve.

11. The method of claim 7, wherein the independently variable-area orifice comprises a valve opening and a plurality of secondary pistons, each secondary piston being operable to extend toward the center of the independently variable-area orifice to at least partially close the valve, and wherein modifying the flow rate of fluid through the independently variable-area orifice comprises extending one or more of the plurality of secondary pistons.

12. The method of claim 7, wherein the independently variable-area orifice comprises a shutter valve, and wherein modifying the flow rate of fluid through the independently variable-area orifice comprises partially opening the shutter valve.

13. The method of claim 7, wherein the independently variable-area orifice comprises a butterfly valve, and wherein modifying the flow rate of fluid through the independently variable-area orifice comprises partially opening the butterfly valve.

14. The method of claim 7, wherein the independently variable-area orifice comprises a valve opening and a plurality of secondary pistons, each piston being operable to extend toward the center of the independently variable-area orifice to at least partially close the valve, and wherein modifying the flow rate of fluid through the independently variable-area orifice comprises retracting one or more of the plurality of secondary pistons.

15. A system for drilling a non-linear wellbore comprising:

a rotary steering tool having a tool housing defining a primary flow channel for passing drilling fluid through a drill bit coupled to a lower end of the tool housing, a plurality of piston-operated steering pad assemblies coupled to the tool housing, and a valve for controlling flow from the primary flow channel to the steering pad assemblies, the valve including a first valve disk having a plurality of valve ports, each valve port comprising an independently-variable area orifice in fluid communication with a respective one of the piston-operated steering pad assemblies a bottom-hole assembly comprising the drill bit;

a controller communicatively coupled to the valve;

a first pressure sensor in fluid communication with a wellbore annulus; and a second pressure sensor in fluid communication with a bore of the bottom-hole assembly, wherein the first pressure sensor and the second pressure sensor are communicatively coupled to the controller, and wherein the primary flow channel provides a fluid flow path for the drilling fluid to flow from the valve through the drill bit without flowing through the drilling pad assemblies.

16. The system of claim 15, wherein the valve further comprises a second, upper disk overlying the first disk, the second disk being rotatable relative to the first disk, wherein the second, upper disk comprises an aperture for periodically allowing flow from the primary flow channel to each of the plurality of valve ports.

17. The system of claim 15, wherein the controller is operable to receive pressure measurements from the first pressure sensor and the second pressure sensor, and to determine a pressure drop across the drill bit based on the received pressure measurements, and wherein the controller is operable to modify a flow area of the independently variable-area orifice based on the determined pressure drop.

18. The system of claim 17, wherein the independently variable-area orifice comprises a plurality of variable area orifices, wherein each of the plurality of valve ports comprises a variable-area orifice, and wherein the controller is operable to modify a flow area of each of the plurality of variable area orifices based on the determined pressure drop.

19. The system of claim 18, wherein the independently variable-area orifice comprises a valve selected from the group consisting of a shutter valve and a butterfly valve.

20. The system of claim 19, wherein the independently variable-area orifice comprises a valve opening and a plurality of secondary pistons, each secondary piston being operable to extend toward the center of the independently variable-area orifice to at least partially close the valve.

* * * * *